US006462526B1

(12) United States Patent
Tanase

(10) Patent No.: US 6,462,526 B1
(45) Date of Patent: Oct. 8, 2002

(54) LOW NOISE BANDGAP VOLTAGE REFERENCE CIRCUIT

(75) Inventor: Gabriel Eugen Tanase, Cupertino, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/920,441

(22) Filed: Aug. 1, 2001

(51) Int. Cl.[7] ..... G05F 3/22
(52) U.S. Cl. ..... 323/313; 327/539
(58) Field of Search ..... 323/313, 314, 323/312; 327/538, 539

(56) References Cited

U.S. PATENT DOCUMENTS

| | | | | | |
|---|---|---|---|---|---|
| 3,617,859 | A | | 11/1971 | Dobkin et al. | |
| 3,887,863 | A | | 6/1975 | Brokaw | |
| 4,626,770 | A | * | 12/1986 | Price, Jr. | 323/313 |
| 4,795,961 | A | | 1/1989 | Neidorff | |
| 5,029,295 | A | * | 7/1991 | Bennett et al. | 323/313 |
| 5,051,686 | A | | 9/1991 | Schaffer | |
| 5,245,273 | A | * | 9/1993 | Greaves et al. | 323/313 |
| 5,619,163 | A | | 4/1997 | Koo | |
| 6,002,293 | A | * | 12/1999 | Brokaw | 327/540 |
| 6,023,189 | A | * | 2/2000 | Seelbach | 327/538 |
| 6,232,829 | B1 | * | 5/2001 | Dow | 327/539 |
| 6,373,330 | B1 | * | 4/2002 | Holloway | 327/539 |

* cited by examiner

*Primary Examiner*—Adolf Deneke Berhane
(74) *Attorney, Agent, or Firm*—Fish & Richardson, P.C., P.A.

(57) ABSTRACT

A bandgap reference adds two bipolar transistors to the conventional bandgap voltage reference. One of these added transistors is Darlington configured with one of the two bipolar transistors used in a conventional bandgap reference, and the other added transistor is configured similarly with the other bipolar transistor used in a conventional bandgap voltage reference. The configuration is such that a portion of the currents that flow into the collector terminal of the two bipolar transistors of the conventional bandgap reference circuit are diverted away to the respective collector terminals of the added transistors. In different embodiments, the bandgap reference also includes two diode-connected bipolar transistors, or alternatively two resistors, coupled between respective emitters of the bipolar transistors used in the conventional bandgap reference and the respective added bipolar transistors. Different areas of emitters for the bipolar transistor are disclosed, to divert more or less current from the conventionally used bipolar transistors, and to achieve different noise profiles for the bandgap reference.

26 Claims, 2 Drawing Sheets

VB
RL2
RL1
OA
Vout
IC2
IC1
RF1
Q2
Q1
VREF
10
RF2
R1
R2

VB
IRL2
RL2
IRL1
RL1
OA
Vout
IC2
IC1
RF1
Q2
Q1
VREF
20
RF2
Q4
Q6
Q5
Q3
R1
ΔV
R2

VB
RL2
RL1
OA
+
−
Vout
RF1
RB
Q1
Q2
VREF
30
RF2
Q4
Q6
Q5
Q3
R1
R2

RL2
RL1
OA
+
−
Vout
RF1
RB
Q1
Q2
VREF
40
RF2
Q4
Q3
R6
R5
R1
R2

LOW NOISE BANDGAP VOLTAGE REFERENCE CIRCUIT

TECHNICAL FIELD

This invention relates to generally to analog and mixed signal (analog and digital) integrated circuits, and in particular to bandgap voltage references used in analog and mixed signal integrated circuits.

BACKGROUND

Reference voltages are required for a variety of purposes. For example, reference voltages are used to bias circuits or to supply a reference to which other voltages are compared. Bandgap voltage references are known in the art, and provide a reference voltage that is quite stable over a range of temperatures. The basic operation of a bandgap voltage reference follows the concept of developing a first voltage with a positive temperature coefficient, combining that voltage with a second voltage having a negative temperature coefficient, and relating the two voltages in a complementary sense such that the resultant composite voltage has a very low temperature coefficient, approximately zero. The voltage produced by bandgap voltage references is related to the bandgap, which for silicon is approximately 1.2 V. Hence, the name for these references.

One known type of bandgap reference is the Brokaw bandgap reference. An example of a Brokaw bandgap reference 10, shown in FIG. 1, includes a pair of bipolar transistors Q2 and Q1 having their base terminals connected together (although in some Brokaw references there may be a resistor connected between the base terminals). Transistors Q2 and Q1 are operated at different current densities, referring to the current flowing through the emitters. In this example, transistor Q1 is operated at a smaller current density. The operation of Q2 and Q1 at different current densities can be achieved in several ways, for example, by transistors Q2 and Q1 having unequal emitter areas but operated at equal currents, by transistors Q2 and Q1 having equal emitter areas and operated at unequal currents, or by some combination of these arrangements. Resistor R1 is connected between the emitters of Q2 and Q1, whose base terminals are connected together (although there could also be a resistor connected between the two bases), and thus a voltage is produced across resistor R1 which is equal to the difference in the base-to-emitter voltages of Q2 and Q1 ($\Delta V_{BE}$). The current through resistor R1 is therefore proportional to $\Delta V_{BE}$. Because the current through resistor R1 is proportional to, and perhaps equal to, the emitter current of Q2, the current through resistor R2 is also proportional to $\Delta V_{BE}$, as will be the voltage appearing across resistor R2.

The base-to-emitter voltage $V_{BE}$ for a transistor has a negative temperature coefficient, governed by the following equation:

$$V_{BE}=V_{G0}[1-(TT_0)]+V_{BE0}(T/T_0)+(nkT/q)*ln(T_0/T)+(kT/q)*ln(I_C/I_{C0})$$

Where $V_{G0}$ is the extrapolated energy bandgap voltage of the semiconductor material at absolute zero (1.205 V for silicon), q is the charge of an electron, n is a constant dependent on the type of transistor (1.5 being a typical example), k is Boltzmann's constant, T is absolute temperature, $I_C$ is collector current, and $V_{BE0}$ is the $V_{BE}$ at $T_0$ and $I_{C0}$. The difference in base-to-emitter voltages, on the other hand, has a positive temperature coefficient governed by the following equation:

$$\Delta V_{BE}=(kT/q)*\ln(J_1/J_2)$$

where J is current density. Reference voltage $V_{REF}$ generated at the base of transistors Q2 and Q1 thus has a positive-temperature-coefficient component and a negative-temperature-coefficient component. For example, the voltage across resistor R2 ($V_{R2}$) has a positive temperature coefficient, and the $V_{BE}$ of Q2 has a negative temperature coefficient. Similarly, the voltage across both resistors R2 and R1 ($V_{R2+R1}$) has a positive temperature coefficient, and the $V_{BE}$ of Q1 has a negative temperature coefficient. An optional voltage divider including resistors $R_{F1}$ and $R_{F2}$ is used to achieve an output voltage $V_{OUT}$ which is a reference voltage that is temperature stable but greater than voltage $V_{REF}$.

Operational amplifier (OA) senses voltages at the collector terminals of Q2 and Q1 and maintains a relatively constant ratio between the currents $I_{C2}$ and $I_{C1}$, and thus maintains a relatively constant ratio between the current densities J1 and J2 of transistors Q2 and Q1. Load resistors $R_{L2}$ and $R_{L1}$ are connected between a supply voltage $V_B$ and the collector of transistor Q2 and the collector of transistor Q1, respectively. For a design having currents $I_{C2}$ and $I_{C1}$, equal to one another, load resistors $R_{L2}$ and $R_{L1}$ will typically be equal to one another. When the output voltage $V_{OUT}$ drops below a pre-established optimal level, the ratio of collector currents $I_{C2}/I_{C1}$ is larger than the ratio of resistors $R_{L2}/R_{L1}$, and thus the input to operational amplifier OA is positive. This causes the amplifier OA output $V_{OUT}$ to increase so that $V_{OUT}$ returns to its optimal level. Conversely, if the output voltage $V_{OUT}$ rises above the optimal level, the feedback action of amplifier OA will have the opposite effect.

In any circuit design, including the prior art Brokaw bandgap reference shown in FIG. 1, electronic noise will be generated during the circuit's operation. There are various sources of this electronic noise. Two important types of noise generated in bandgap voltage references, and which dictate a minimum quiescent current, are 1/f noise (also known as flicker noise) and wideband noise. In the FIG. 1 circuit, flicker noise is developed at R1 and R2 because of the noise in the base currents of Q2 and Q1 which flow through R1 and R2. The flicker noise level is directly related to the magnitude of these base currents. Wideband noise for $V_{OUT}$ in the FIG. 1 circuit is due to the collector currents of Q2 and Q1. Generally, the higher the collector current, the lower the wideband noise. This illustrates that different circuit designs trade reduction in one type of noise for an increase in another type of noise. Consideration of noise in circuit design is becoming increasingly important, because of the need for lower quiescent currents and also because of ever smaller device feature sizes. Different circuit designs are needed that enable circuit designers to meet more stringent noise requirements.

SUMMARY

Generally, the invention is an improved bandgap voltage reference having advantageous noise characteristics. In one aspect, the invention adds two bipolar transistors to a conventional bandgap voltage reference. One of these added transistors is Darlington configured with one of the two bipolar transistors used in a conventional bandgap reference, and the other added transistor is configured similarly with the other bipolar transistor used in a conventional bandgap voltage reference. The configuration is such that a portion of the currents that flow into the collector terminal of the two bipolar transistors of the conventional bandgap reference circuit are diverted away to the respective collector terminals of the added transistors.

In different embodiments, the inventive bandgap reference includes two diode-connected bipolar transistors, or alternatively resistors, coupled between respective emitters of the bipolar transistors used in the conventional bandgap reference and the respective additional bipolar transistors added in accordance with the invention. Different areas of emitters for the bipolar transistor are contemplated, to divert more or less current from the conventionally used bipolar transistors, and to achieve different noise profiles. In addition, the bandgap reference of the present invention may have various design difference known in the art, such as a feedback mechanism, a voltage divider, and a resistor between the base terminals of the bipolar transistors used in conventional bandgap references.

The different embodiments of the invention have one or more of the following advantages. Compared to prior art circuits, the bandgap reference generates lower flicker noise for a given quiescent current used by the reference. The bandgap reference may also generate lower wideband noise. The voltage reference embodiments therefore provide alternative circuit designs with different noise profiles than were previously known, and allow designers to meet more stringent design constraints.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
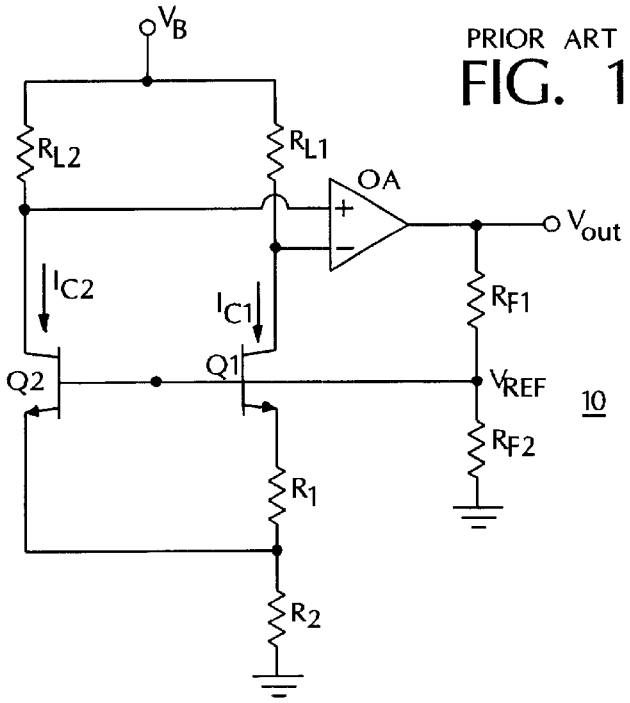
PRIOR ART FIG. 1
FIG. 1 is a schematic of a prior art bandgap reference circuit.
Figure 2:
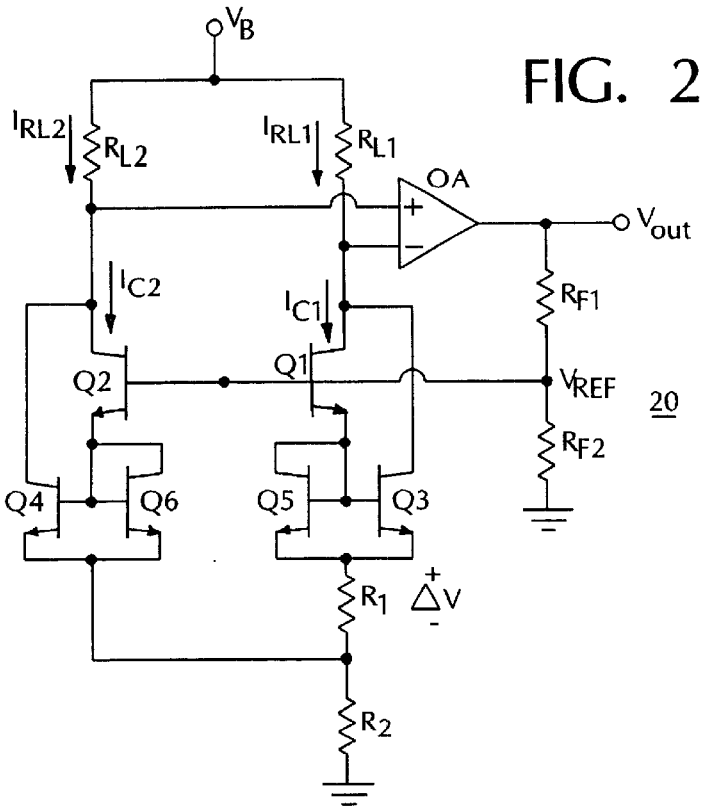
FIG. 2 is a schematic of an embodiment of a bandgap reference circuit in accordance with the invention.

An embodiment of a bandgap reference 20 in accordance with the invention, shown in FIG. 2, is an improvement upon the prior art bandgap reference 10 shown in FIG. 1. Compared to the bandgap reference 10 of FIG. 1, bandgap reference 20 includes a pair of bipolar transistors Q4 and Q3 and a pair of diode-connected bipolar transistors Q6 and Q5. Bipolar transistors Q4 and Q3 have their respective collector terminals connected to the collector terminals of bipolar transistors Q2 and Q1, respectively, and have their respective base terminals connected to the emitter terminals of bipolar transistors Q2 and Q1, respectively. As such, transistors Q2 and Q4 are in a Darlington configuration, as are transistors Q1 and Q3. Diode-connected transistors Q6 and Q5 have their respective collector/base terminals connected to the emitter terminals of Q2 and Q1, respectively.

The reference voltage $V_{REF}$ equals the sum of $V_{BE(Q2)}$, $V_{BE(Q4\ or\ Q6)}$ and $V_{R2}$, which also equals the sum of $V_{BE(Q1)}$, $V_{BE(Q3\ or\ Q5)}$, $V_{R1}$ and $V_{R2}$. Therefore, $V_{REF}$, and thus also the output voltage $V_{OUT}$, have negative temperature coefficient components and positive temperature coefficient components, as with prior art bandgap reference circuits. Because the reference voltage $V_{REF}$ in this embodiment has as components two $V_{BE}$ voltages (for example, $V_{BE(Q1)}$ and $V_{BE(Q3\ or\ Q5)}$), the $V_{REF}$ voltage will be greater than two times the bandgap voltage, that is, greater than 2.4 Volts. Resistors R1 and R2 function as previously described in the FIG. 1 reference 10, with the voltage across these resistors being related to $V_{BE}$ and thus R1 and R2 each have a positive temperature coefficient. $V_{BE}$ voltages have negative temperature coefficients, and thus the $V_{BE}$ voltages for Q2, Q1, Q6 and Q5 each have negative temperature coefficients. Therefore, the reference voltage $V_{REF}$, and thus the output voltage $V_{OUT}$, combine voltages with both positive and negative temperature coefficients, and thus is relatively stable across a range of temperatures. Voltage divider $R_{F1}$ and $R_{F2}$ function as has been previously described to produce a temperature-stable output voltage $V_{OUT}$ that is of a higher voltage than $V_{REF}$. Also, the feedback circuitry including operational amplifier OA and load resistors $R_{L2}$ and $R_{L1}$ function as previously described.

In FIG. 2, current $I_{RL2}$ through resistor $R_{L2}$ splits between transistors Q2 and Q4, and current $I_{RL1}$ through resistor $R_{L1}$ splits between transistors Q1 and Q3. Collector currents $I_{C2}$ and $I_{C1}$ of transistors Q2 and Q1 are therefore reduced in comparison to prior art bandgap references having comparable quiescent currents. Therefore, because the relationship between the collector current and the base current is governed by the linear equation $\beta=I_C/I_B$, base currents $I_{B(Q2)}$ and $I_{B(Q1)}$ of Q2 and Q1 are likewise reduced proportionally. A reduction in base currents $I_{B(Q2)}$ and $I_{B(Q1)}$ yields a reduction in 1/f noise. Therefore, bandgap references can be designed with lower 1/f noise for the same quiescent current, or alternatively, with lower quiescent currents for a given 1/f noise budget. In addition, wideband noise generated by reference 20, because of the presence of transistors Q6 and Q5, is also reduced compared to the prior art reference 10 of FIG. 1. On the other hand, the diversion of current away from the collectors of Q2 and Q1 by the presence of Q4 and Q3 will increase the circuit's wideband noise. Therefore, as compared to a reference having transistors Q2, Q1, Q6 and Q5, but not Q4 and Q3, there is a tradeoff between flicker noise benefits and increased wideband noise. This will be a desirable tradeoff in many cases.

In one embodiment, the emitter area ratios for transistors Q1–Q6 may be $A_{Q1}/A_{Q2}=N$; $A_{Q4}/A_{Q6}=1$, $A_{Q3}/A_{Q5}=1$, and $A_{Q5}/A_{Q6}=N$. The value of N may have a minimum value of about four, in many cases may be about eight, and in some cases may be as high as 100. Also, the currents $I_{RL2}$ and $I_{RL1}$ through resistors $R_{L2}$ and $R_{L1}$ may be designed to be equal, and the value of resistor $R_{L2}$ may equal that of resistor $R_{L1}$. In such an embodiment, the voltage across R1 ($\Delta V$) is therefore equal to $[V_{BE(Q2)}+V_{BE(Q6)}]-[V_{BE(Q1)}+V_{BE(Q5)}]$, and thus, using the equation discussed above, equal to $(2kT/q)*\ln(N)$. Also in this embodiment, current $I_{RL2}$ through resistor $R_{L2}$ will be split roughly equally between current $I_{C(Q2)}$ received at the collector terminal of Q2 and $I_{C(Q4)}$ received at the collector terminal of Q4. Current $I_{RL1}$ through resistor $R_{L1}$ likewise will be split roughly equally between current $I_{C(Q1)}$ received at the collector terminal of Q1 and $I_{C(Q3)}$ received at the collector of Q3. Base currents $I_{B(Q2)}$ and $I_{B(Q1)}$ of Q2 and Q1 are reduced roughly by a factor of two, and thus 1/f noise is reduced roughly by a factor of the square root of two. Wideband noise is also reduced roughly by a square root of two factor, minus what in many cases will be a modest increase in the additional wideband noise generated by the circuit 10 by virtue of the addition of Q4 and Q3.

In another embodiment, the emitter area ratios for transistors Q1–Q6 may be $A_{Q1}/A_{Q2}$=N; $A_{Q4}/A_{Q6}$=2, $A_{Q3}/A_{Q5}$=2, and $A_{Q5}/A_{Q6}$=N. In this embodiment, more current will be diverted away from Q1 ($I_{C1}$) and to Q3. As such, flicker noise is reduced even further (compared to the embodiment where $A_{Q4}/A_{Q6}$=1 and $A_{Q3}/A_{Q5}$=1. However, as one skilled in the art will appreciate, this further reduction in flicker noise will need to be weighed against the increased wideband noise developed by virtue of there being decreased collector current in Q6 and Q5. As one skilled in the art will recognize, this trade-off between the different types of noise is not only dictated by the ratio of current diverted (away from Q1 and into Q3), but also by process parameters of the transistors.

Figure 3:
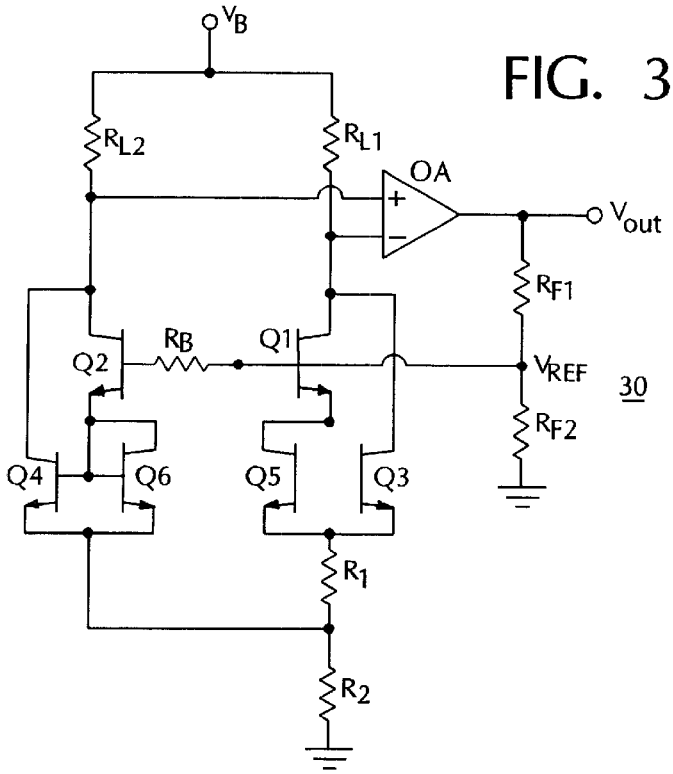
FIG. 3 is a schematic of an alternative embodiment of a bandgap reference circuit in accordance with the invention.

In FIG. 3, the bandgap reference 30 includes a resistor $R_B$ between, on the one hand, the common node of the Q1 base and $V_{REF}$, and on the other hand, the base of Q2. Resistor $R_B$ is added, as is conventional in Brokaw bandgap references, to cancel the effects of the finite base currents going through $R_{F1}$, and $R_B$ is chosen according to the following formula:

$$R_B \square [R1/(R1+R2)]^*(R_{F1}\|R_{R2})$$

Figure 4:
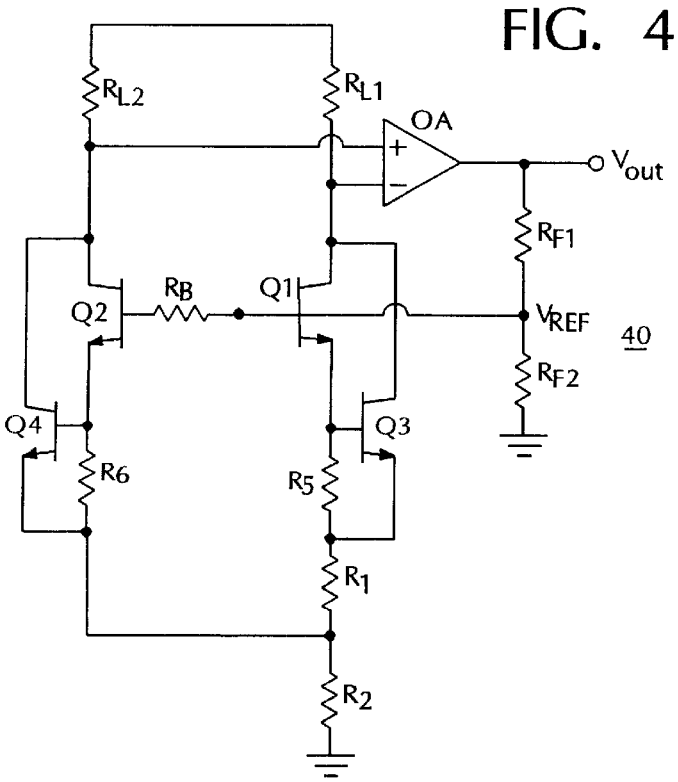
FIG. 4 is a schematic of yet another alternative embodiment of a bandgap reference circuit in accordance with the invention.

In this embodiment, the emitter area ratios may be, for example, $A_{Q1}/A_{Q2}$=N; $A_{Q4}/A_{Q6}$=n, $A_{Q3}/A_{Q5}$=n, and $A_{Q5}/A_{Q6}$=N. In FIG. 4, diode-connected transistors Q6 and Q5 used in the FIG. 2 and 3 embodiments are replaced with resistors R6 and R5. In this embodiment, there will be improved flicker noise as with the FIG. 2 and 3 embodiments, however, there will be a greater wideband noise penalty. In some cases, this tradeoff will be acceptable. The FIG. 4 embodiment includes resistor $R_B$ connected between the bases of Q2 and Q1, although it will be understood that resistor $R_B$ may not be included in all embodiments.

A number of embodiments of the invention have been described. Nevertheless, it will be understood that various modifications may be made without departing from the spirit and scope of the invention. For example, and has already been explained to some extent, various emitter areas for transistors Q2 through Q3 may be used. In addition, different emitter areas need not be used, for example, where different currents $I_{RL2}$ and $I_{RL1}$ are employed. Also, other embodiment may employ resistors $R_{L2}$ and $R_{L1}$ that have different resistance values. Other embodiments may not include resistor divider $R_{F1}$ and $R_{F2}$, for example, where the higher voltage reference is not needed. In addition, a third transistor may be added to the Darlington configuration and still achieve some of the advantages of the invention. Accordingly, other embodiments are within the scope of the following claims.

What is claimed is:

1. A bandgap voltage reference comprising:

first and second bipolar transistors coupled in relation to one another such that their base-to-emitter voltages are serially related;

third and fourth bipolar transistors, the collector terminals of the third and fourth bipolar transistors connected respectively to the collector terminal of the first bipolar transistor and the collector terminal of the second bipolar transistor, the base terminals of the third and fourth bipolar transistors connected respectively to the emitter terminal of the first bipolar transistor and the emitter terminal of the second bipolar transistor;

a first resistor operably coupled to produce a voltage thereon proportional to the difference in the sum of base-to-emitter voltages of the first and third bipolar transistors and the sum of base-to-emitter voltages of the second and fourth bipolar transistors, and wherein a voltage appearing on the base terminal of the first bipolar transistor combines at least the voltage across the first resistor with the sum of base-to-emitter voltages of the first and third bipolar transistors.

2. The bandgap voltage reference of claim 1 further comprising fifth and sixth bipolar transistors, the base and collector terminals of the fifth bipolar transistor connected together and to the emitter terminal of the first bipolar transistor, the base and collector terminals of the sixth bipolar transistor connected together and to the emitter terminal of the second bipolar transistor, and the emitter terminals of the fifth and sixth bipolar transistors connected respectively to the emitter terminals of the third and fourth bipolar transistors.

3. The bandgap voltage reference of claim 1 further comprising:

a fifth resistor coupled between the emitters of the first and third bipolar transistors; and a sixth resistor coupled between the emitters of the second and fourth bipolar transistors.

4. The bandgap voltage reference of claim 1 further comprising feedback circuitry operably coupled to sense voltages at the collector terminals of the first and second bipolar transistors and operably coupled to the base of the first and second bipolar transistors to maintain a relatively constant ratio in the density of current in the first and third bipolar transistors compared to the density of current in the second and fourth bipolar transistors.

5. The bandgap voltage reference of claim 4 wherein the first transistor has an emitter area larger than an emitter area of the second transistor, and wherein the feedback circuitry forces the sum of currents received at the collectors of the first and third transistors to be equal to the sum of currents received at the collectors of the second and fourth transistors.

6. The bandgap voltage reference of claim 5 wherein the third and fourth transistors have emitter areas that differ according a ratio of the emitter areas of the first and second transistors, and wherein the current received at the collector of the third transistor is equal to the current received at the collector of the fourth transistor.

7. The bandgap voltage reference of claim 6 further comprising fifth and sixth bipolar transistors, the base and collector terminals of the fifth bipolar transistor connected together and to the emitter terminal of the first bipolar transistor, the base and collector terminals of the sixth bipolar transistor connected together and to the emitter terminal of the second bipolar transistor, and the emitter terminals of the fifth and sixth bipolar transistors connected respectively to the emitter terminals of the third and fourth bipolar transistors.

8. The bandgap voltage reference of claim 7 wherein the fifth and sixth transistors have emitter areas that differ according to a ratio of the emitter areas of the first and second transistors, and wherein the current received at the collector of the fifth transistor is equal to the current received at the collector of the sixth transistor.

9. The bandgap voltage reference of claim 4 wherein the first and second transistors have emitter areas that are equal to one another, and wherein the feedback circuitry forces the sum of currents received at the collectors of the first and third transistors to differ from the sum of currents received at the collectors of the second and fourth transistors.

10. The bandgap voltage reference of claim 4 wherein the feedback circuitry comprises an operational amplifier that receives a measure of voltage at the collector terminals of the first and third transistors and a measure of voltage at the collector terminals of the second and fourth transistors, and that has an output operably coupled to the base terminals of the first and second transistors.

11. The bandgap voltage reference of claim 10, wherein the feedback circuitry further comprises:

a first load resistor operably coupled between the collector terminal of the first transistor and a voltage supply; and a second load resistor operably coupled between the collector terminal of the second transistor and the voltage supply; and wherein the operational amplifier senses the voltage at a node between the first load resistor and the collector terminal of the first transistor, and also senses a voltage at a node between the second load resistor and the collector terminal of the second transistor.

12. The bandgap voltage reference of claim 11 wherein the first load resistor has a resistance value that equals that of the second load resistor, and wherein the operational amplifier produces a voltage that causes the first and second transistors to be biased so that the current flowing through the first resistor equals the current flowing through the second resistor.

13. The bandgap voltage reference of claim 4, further comprising a voltage divider comprising:

a first divider resistor coupled between the output of the feedback circuitry and at least one of the base terminals of the first and second transistors; and a second divider resistor coupled between the at least one of the base terminals of the first and second transistors and a ground.

14. The bandgap voltage reference of claim 1 further comprising a base resistor coupled between the base terminal of the first transistor and the base terminal of the second transistor.

15. The bandgap voltage reference of claim 1 wherein the first resistor comprises a first and a second discrete resistor component, the first discrete resistor component coupled between the emitters of the third and fourth bipolar transistors, and the second discrete resistor component coupled between the emitter of the fourth bipolar transistor and ground.

16. A bandgap voltage reference comprising:

first and second bipolar transistors coupled in relation to one another such that their base-to-emitter voltages are serially related;

third and fourth bipolar transistors, the collector terminals of the third and fourth bipolar transistors connected respectively to the collector terminal of the first bipolar transistor and the collector terminal of the second bipolar transistor, the base terminals of the third and fourth bipolar transistors connected respectively to the emitter terminal of the first bipolar transistor and the emitter terminal of the second bipolar transistor;

fifth and sixth bipolar transistors, the base and collector terminals of the fifth bipolar transistor connected together and to the emitter terminal of the first bipolar transistor, the base and collector terminals of the sixth bipolar transistor connected together and to the emitter terminal of the second bipolar transistor, and the emitter terminals of the fifth and sixth bipolar transistors connected respectively to the emitter terminals of the third and fourth bipolar transistors;

a first resistor operably coupled to receive the combined current from the emitter terminals of the third, fourth, fifth and sixth bipolar transistors, the resistor producing a voltage thereon proportional to the difference in base-to-emitter voltages of the first and second bipolar transistors and the difference in the base-to-emitter voltages of the fifth and sixth bipolar transistors;

feedback circuitry operably coupled to sense voltages at the collector terminals of the first and second bipolar transistors and operably coupled to the base of the first and second bipolar transistors to maintain a relatively constant ratio in the density of current in the first and third bipolar transistors compared to the density of current in the second and fourth bipolar transistors; and wherein a voltage appearing on the base terminal of the first bipolar transistor combines at least the voltage across the first resistor with the sum of base-to-emitter voltages of the first and third bipolar transistors.

17. The bandgap voltage reference of claim 16 wherein the first transistor has an emitter area larger than an emitter area of the second transistor, and wherein the feedback circuitry forces the sum of the currents received at the collectors of the first and third transistors to be equal to the sum of currents received at the collectors of the second and fourth transistors.

18. The bandgap voltage reference of claim 17 wherein the third and fourth transistors have emitter areas that differ according a ratio of the emitter areas of the first and second transistors, and wherein the current received at the collector of the third transistor is equal to the current received at the collector of the fourth transistor.

19. The bandgap voltage reference of claim 18 wherein the fifth and sixth transistors have emitter areas that differ according to a ratio of the emitter areas of the first and second transistors, and wherein the current received at the collector of the fifth transistor is equal to the current received at the collector of the sixth transistor.

20. The bandgap voltage reference of claim 16 wherein the first and second transistors have emitter areas that are equal to one another, and wherein the feedback circuitry forces the sum of currents received at the collectors of the first and third transistors to differ from the sum of currents received at the collectors of the second and fourth transistors.

21. The bandgap voltage reference of claim 16 wherein the feedback circuitry comprises an operational amplifier that receives a measure of the voltage at the collector terminals of the first and third transistors and a measure of the voltage at the collector terminals of the second and fourth transistors, and that has an output operably coupled to the base terminals of the first and second transistors.

22. The bandgap voltage reference of claim 21, wherein the feedback circuitry further comprises:

a first load resistor operably coupled between the collector terminal of the first transistor and a voltage supply; and a second load resistor operably coupled between the collector terminal of the second transistor and the voltage supply; and wherein the operational amplifier senses the voltage at a node between the first load resistor and the collector terminal of the first transistor, and also senses a voltage at a node between the second load resistor and the collector terminal of the second transistor.

23. The band gap voltage reference of claim 22 wherein the first load resistor has a resistance value that equals that of the second load resistor, and wherein the operational amplifier produces a voltage that causes the first and second transistors to be biased so that the current flowing through the first resistor equals the current flowing through the second resistor.

24. The bandgap voltage reference of claim 16, further comprising a voltage divider comprising:

a first divider resistor coupled between the output of the feedback circuitry and at least one of the base terminals of the first and second transistors; and a second divider resistor coupled between the at least one of the base terminals of the first and second transistors and a ground.

25. The bandgap voltage reference of claim 16 further comprising a base resistor coupled between the base terminal of the first transistor and the base terminal of the second transistor.

26. The bandgap voltage reference of claim 16 wherein the first resistor comprises a first and a second discrete resistor component, the first discrete resistor component coupled between the emitters of the third and fourth bipolar transistors, and the second discrete resistor component coupled between the emitter of the fourth bipolar transistor and ground.

* * * * *